US005320255A

United States Patent [19]

Stoffel et al.

[11] Patent Number: 5,320,255

[45] Date of Patent: Jun. 14, 1994

[54] PRESSURIZED DISPENSING CONTAINER, ASSEMBLY AND VALVE THEREFOR, AND METHOD OF MAKING CONTAINER

[75] Inventors: Hans F. Stoffel, Rye; Charles Fuehrer, Scarsdale, both of N.Y.

[73] Assignee: Praezision Werkzeuge AG, Rueti, Switzerland

[21] Appl. No.: 878,428

[22] Filed: May 4, 1992

[51] Int. Cl.[5] ..... B65D 37/00

[52] U.S. Cl. ..... 222/212; 222/402.1

[58] Field of Search ..... 222/94, 211, 212, 153, 222/386.5, 402.1; 299/90

[56] References Cited

U.S. PATENT DOCUMENTS

| | | | |
|---|---|---|---|
| 2,823,953 | 7/1954 | McGeorge | 299/90 |
| 3,342,377 | 4/1966 | Peredy | 222/94 |
| 3,992,003 | 11/1966 | Visceglia et al. | 222/94 |
| 4,147,278 | 4/1979 | Uhlig | 222/94 |
| 4,159,790 | 7/1979 | Bailey | 222/211 |
| 4,189,069 | 2/1980 | Stoody | 222/94 |
| 4,239,132 | 12/1980 | Mueller et al. | 222/212 |
| 4,553,683 | 11/1985 | Magid | 222/1 |
| 4,760,937 | 8/1988 | Evezich | 222/95 |
| 4,863,070 | 9/1989 | Andris | 222/212 |
| 4,875,508 | 11/1989 | Burke, II et al. | 141/2 |
| 4,940,167 | 7/1990 | Fillmore et al. | 222/153 |
| 4,955,512 | 9/1990 | Sharples | 222/386.5 |

*Primary Examiner*—Jesus D. Sotelo

*Attorney, Agent, or Firm*—Antonelli, Terry, Stout & Kraus

[57] ABSTRACT

A container for storing a product under pressure and dispensing the stored product comprises a container body having screw threads arranged about an opening of the container body, a valve for dispensing a pressurized product from the container, and a closure having screw threads thereon threaded onto the threaded container body for fastening the closure and the valve to the container body to close the opening. One or more passages are provided in the container body and/or the closure for introducing pressurized gas between the closure and container body and into the container through the container opening when the closure is being screwed onto the container body. In a preferred embodiment, the container is a barrier pack container having an inner collapsible container located within the container body to provide separate chambers for propellent and product. The inner collapsible container is sealingly retained onto the valve during assembly of the container at a valve portion having on each of two opposite sides thereof an outwardly flared portion which tapers to an outer tip.

46 Claims, 5 Drawing Sheets

PRESSURIZED DISPENSING CONTAINER, ASSEMBLY AND VALVE THEREFOR, AND METHOD OF MAKING CONTAINER

DESCRIPTION

1. Technical Field

The present invention relates to containers of the type having a pressurized product stored therein which can be dispensed from the container by means of a valve of the container. A propellant can be mixed with the product or separate therefrom as in the case of a barrier pack container.

2. Background Art

Conventional containers for pressure dispensing are generally formed with a metal outer container body which has an opening in its upper end. The opening is closed by a metal valve cup on which a dispensing valve is mounted. The valve cup is joined to an upper rim of the container body about the opening by clinching. This conventional pressurized dispensing container is filled with a propellant mixed with the product. The shape of the outer metal container bodies in these containers is limited because of the formability and process limitations in fabricating metal containers.

Containers of plastic, rather than metal, are preferred by many consumers because of their look and feel. However, clinching of a valve cup to a plastic container body can create a safety hazard, as compared with a metal container in as much as the valve cup may accidently fly off the container body due to extreme temperature or unusual impact of the container.

Thus, there is a need for an improved container for pressure dispensing which avoids the aforementioned drawbacks and disadvantages of known containers. In particular, there is a need for an improved pressurized dispensing container and a method of forming the same which readily permit the use of plastic materials, as construction materials for the containers without fear that the valve cups will fly off. There is also a need for an improved method of making a safe, reliable container quickly and inexpensively without substantial restriction on the shape of the container.

Barrier pack containers having a twin-chamber type of construction are known but not widely used. This type of container construction typically comprises an outer container body made of a steel or aluminum on which a valve cup with valve is mounted by clinching the valve cup to the upper rim of the outer container body.

In one known type of barrier pack container an inner collapsible container is mounted within the outer container to provide separate chambers for the product and the propellant. The product is contained within the collapsible container and a pressurized gas propellant is located in an intermediate chamber defined between the outer container body and the inner collapsible container. In most of these containers, the pressurized gas is introduced into the intermediate chamber by bottom gassing through a hole in the bottom of the outer container body. The hole is closed with a plug. The gas in the intermediate chamber presses on the inner collapsible container and any product therein for dispensing the product upon actuation of the valve. In other barrier pack containers, the pressurized gas is introduced into the intermediate chamber by undercup gassing, followed by clinching the metal valve cup to the metal outer container.

The inner collapsible container in twin-chamber containers is typically formed of aluminum, plastic or a laminated film. It must be non-porous to prevent leakage between the respective chambers of the container. This makes it necessary to provide a leak-proof seal at the connection of the inner collapsible container with the remainder of the container.

A second known type of barrier pack container construction comprises a movable piston within the outer container body, rather than an inner collapsible container. The piston divides the container into product and propellant chambers. The piston type barrier pack container construction is disadvantageous because expensive tooling is required to make the container wall concentric to within close tolerances where the piston is expected to move. If the container gets dented, bypassing of the propellant from one side of the piston to other is likely to occur resulting in failure of operation of the container. Bottom gassing through a hole in the bottom of the container, is necessary to introduce the pressurized gas propellant into the container beneath the piston.

While bottom gassing is done on most known barrier pack containers, it is problematical because it requires the formation of a hole in the container bottom which introduces an additional possibility of leakage of the propellant gas. For proper sealing, the shape of the hole in the bottom of the container is critical and the dimensions of the hole are hard to control during manufacture. Also, if the container edge about the hole is too sharp, it can cut the rubber plug and cause a leak. Rubber for the plug is available either in pellets or on a continuous roll. There are two methods of application of the plugs. In one method the can supplier delivers the can with the plug on it and the gassing is done with a needle through the plug. The other method requires the filler to put the plug in the hole after bottom gassing.

Barrier pack containers are advantageous in that the propellant in the intermediate chamber is not mixed with the product to be dispensed from the inner collapsible container. The environmental drawbacks sometimes associated with dispensing certain propellants along with the product can be avoided with the barrier pack container because in the barrier pack container the propellant remains in the container. However, the known twin-chamber containers are relatively expensive, requiring special container components and apparatus for their production. There is a need for an improved, relatively lower cost barrier pack container, and a method of making the same. In particular, there is a need for an relatively inexpensive barrier pack container which can be of plastic and which is capable of safely storing and dispensing products, especially sterile products, for example, saline solution for cleaning contact lenses, with minimal possibility of leakage and failure.

DISCLOSURE OF INVENTION

An object of the present invention is to provide an improved pressurized dispensing container for storing and dispensing a product and a method of making the container which avoid the aforementioned drawbacks and disadvantages of known containers and methods of making the same. More particularly, an object of the invention is to provide an improved pressurized dispensing container and a method of making the same where the container body can be relatively inexpensive and can be formed of plastic without fear that the top of the container will fly off.

An additional object of the invention is to provide an improved, relatively low cost pressurized dispensing container and a method of making the same that enable a sterile product to be stored and dispensed without fear of loss of sterility of the product while it is being stored and without exposure of the stored product to oxygen so that preservatives in the product can be reduced or eliminated.

A further object of the invention is to provide an improved barrier pack pressurized dispensing container, an assembly therefor including a valve accoding to the invention, and a method of making the container wherein the product and the propellant are separated from one another with minimal possibility of leakage and wherein the outer container body of the container can be a relatively inexpensive, standard size plastic container body such as those used in containers without valves.

A further object of the invention is to provide a barrier pack, pressurized dispensing container which facilitates introduction of pressurized gas into an intermediate chamber of the barrier pack container without bottom gassing and before the container closure is secured tightly onto the outer container body.

These and other objects are attained by the improved pressurized dispensing container of the invention which comprises a container body having an opening with screw threads arranged on the container body about the opening, a valve for dispensing a pressurized product from the container, and a closure having screw threads thereon in threaded engagement with the threads of the container body about the opening for fastening the closure and the valve to the container body to close the opening.

The container further includes at least one passage in at least one of the container body and the closure through which pressurized gas can be flowed into the container body through said opening when the closure is being screwed onto the container body. The container is constructed so that pressurized gas flow communication between said at least one passage and the container body opening is closed when the closure is screwed tightly onto the container body to close said opening. In disclosed embodiments of the invention, the opening of the container body is located in a threaded neck of the container body. The valve and closure can be separate elements mounted together on the container body, but preferably the two are formed as an assembly prior to mounting on the container body.

The pressurized dispensing container with valve according to the invention can have either a single chamber or a barrier pack type of construction. Preferably, a standard size threaded container body, illustratively a conventional plastic soda bottle, is used to make the dispensing container whereby the cost of the pressurized dispensing container can be kept relatively low. The combination of the threaded connection between the closure and the container body and the as least one passage in at least one of the container body and the closure through which pressurized gas can be flowed to between the container body and closure to and through the opening into the container when the closure is partially screwed onto the container body, substantially eliminates the risk of the container closure and valve flying off the plastic container body and avoids the need for bottom gassing or otherwise gassing the container. A container bottom hole and a plug for the hole, which permit bottom gassing in the prior art containers, are therefore not necessary in the pressurized dispensing container of the invention. The container construction according to the invention also ensures safe depressurizing of the container in the event of disassembly for disposal and recycling. That is, the pressure in the container is released through the at least one passage during unscrewing of the closure from the container body before the closure can be removed from the container body.

The container according to a first embodiment of the invention contains a product which is mixed with a pressurized propellant and stored in a single chamber of the container for dispensing. In a second embodiment, the container is a barrier pack, pressurized dispensing container wherein the propellant and product are separated from one another by an inner collapsible container provided in the container.

The at least one passage in the container body and/or closure through which pressurized gas can be flowed between the container body and closure and into the opening of the container body, according to one form of the invention, comprises slots formed in the screw threads of at least one of the container body and closure. The slots extend transverse to the longitudinal direction of the screw threads to permit ingress of pressurized gas, possibly mixed with product in the case of a single chamber container, while the closure is incompletely threaded onto the container body. Slots are formed in only the screw threads of the container body in the disclosed preferred form of the invention. According to another form of the invention, the at least one passage comprises apertures extending through the closure in a location adjacent the screw threads.

To prevent accidental unscrewing of the container closure and loss of the pressure necessary for dispensing, as a further feature of the invention, the container preferably includes means for resisting unscrewing of the closure with respect to the container body after the closure has been tightly screwed onto the container body. The means for resisting unscrewing preferably comprises a radially inwardly extending projection on the closure which forms part of a snap-on arrangement with the outer container body when the closure is screwed tightly on the outer container body. The outer surface of the closure is also preferably formed with a surface making it difficult to grip the closure to rotate it for unscrewing, such as a smooth or one-way closing surface.

Sterile conditions in the container are maintained even with dispensing of pressurized product from the container since the value is normally closed, except when filling or dispensing, to thereby preclude ingress of oxygen and other atmospheric contaminates. The screw threads of the container body and closure are preferably buttress threads or other steep threads for resisting the pressure within the container. In the disclosed embodiments of the invention, the container body has a neck with screw threads formed thereon about an opening in the neck. The closures of the disclosed container are in the form of a cap having screw threads formed thereon.

The improved barrier pack, pressurized dispensing container according to the invention comprises an inner collapsible container located within the container body for containing a product to be stored and dispensed.

The inner collapsible container is arranged within the container body such that the interior of the collapsible container is in communication with the valve. According to the invention, a standard size container, such as commercially available plastic beverage container for soda, is preferably employed as the outer container body whereby the cost for the container is kept relatively low. The standard container can have any of a variety of different, commercially available shapes and sizes. Both the outer container body and the cap are made of plastic in the illustrated embodiments.

The inner collapsible container is bonded as by heat sealing to a portion of the valve for retaining the inner collapsible container on the valve. The portion of the valve to which the collapsible container is bonded preferably has an outer configuration, as seen in a cross-section taken perpendicular to a longitudinal central axis of the portion, which has on each of two opposite sides thereof an outwardly flared portion which tapers to an outer tip of the flared portion. This avoids bunching of the material of the collapsible container about the valve and reduces the possibility of leakage through the bonded connection between the collapsible container and valve. The tapering surfaces of the flared portion are harmonically curved surfaces in the disclosed embodiment.

The method of the invention for making a pressurized dispensing container comprises providing a container body, a threaded closure and a valve according to the invention as referred to above. The method includes introducing a pressurized gas into the container between the closure and the container body before the closure is completely screwed onto the container body to sealingly close the opening in the container body and securely mount the valve on the container body. The gas flows through the at least one passage, between the container body and the closure to the opening in the container body and through the opening into the container.

When making a barrier pack container according to the method, an inner collapsible container is provided within the container body for containing the product to be stored and dispensed in the container. An intermediate chamber is defined in the container between the container body and the inner collapsible container. The pressurized gas is introduced into this intermediate chamber. The collapsible container is retained on the valve during the step of introducing a pressurized gas into the intermediate chamber. After introduction of the pressurized gas into the intermediate chamber, communication between the at least one passage and the intermediate chamber is closed by further threading of the closure onto the container body. Preferably, the valve and closure are formed as an assembly prior to mounting on the container body. In the illustrated embodiment, this assembly also includes a seal which extends about the container body opening between the valve and container body when the assembly is mounted onto the container body. The seal engages the container body and the outer rim of a valve cup of the valve and the valve cup and seal are pressed in the direction of the container body by the closure to close the opening.

These and other objects, features and advantages of the present invention will become more apparent from the following description when taken in connection with the accompanying drawings, which show, for purposes of illustration only, two embodiments in accordance with the invention.

BEST MODE FOR CARRYING OUT THE INVENTION

Figure 1A:
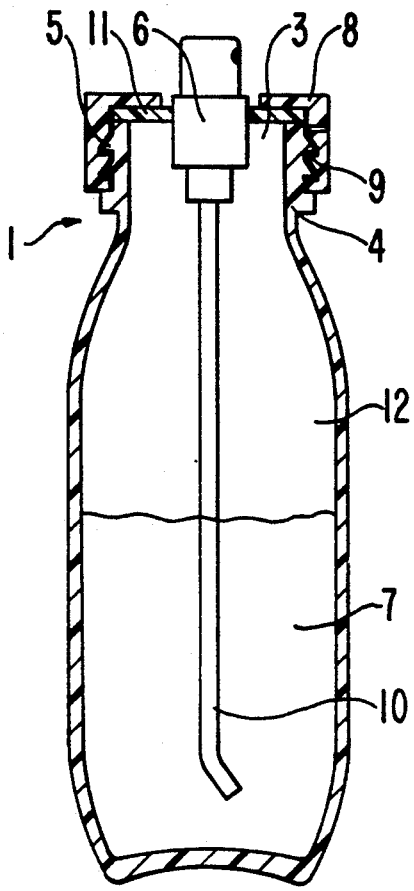
FIG. 1A is a side view, partially in cross-section, taken along the longitudinal central axis of a container for pressure dispensing according to a first embodiment of the invention.
Figure 1B:
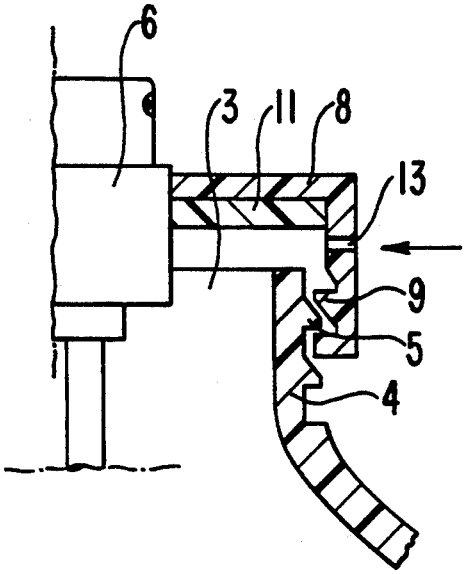
FIG. 1B is an enlarged view of a portion of the container of FIG. 1A shown during assembly where the threaded closure is only partially screwed onto the container body and pressurized gas is being introduced into the container through the closure.
Figure 1C:
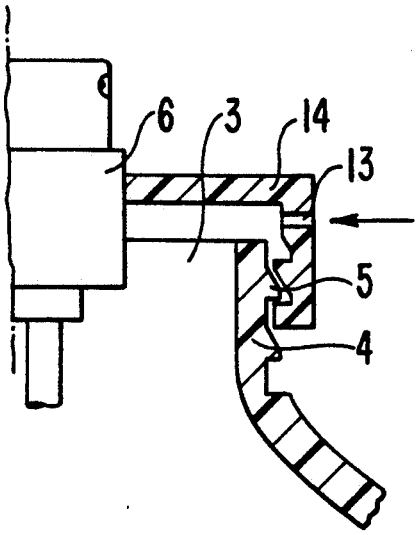
FIG. 1C is an enlarged view of a portion of a container like that in FIG. 1A except that the closure is formed as an integral part of the valve.
Figure 2A:
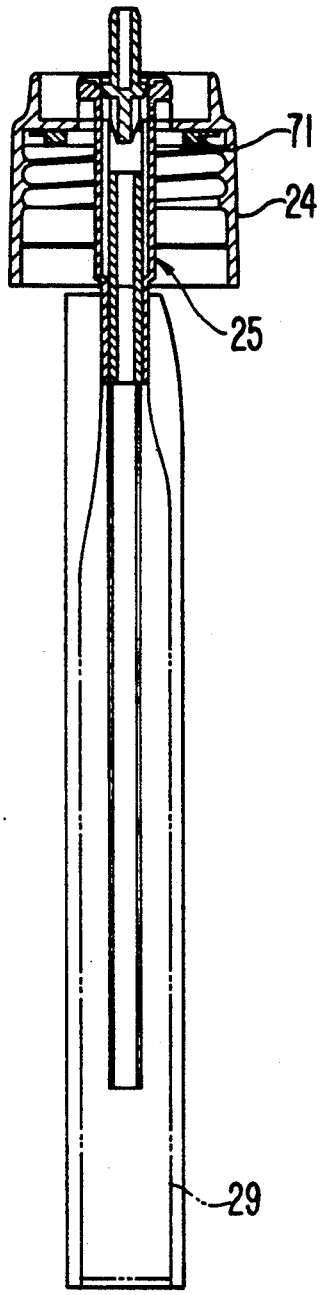
FIG. 2A is an elevational view of a threaded closure, in the form of a screw cap, having a valve with a valve cup mounted on the closure for a barrier pack, pressurized dispensing according to a second embodiment of the invention as illustrated in FIG. 2B.
Figure 2B:
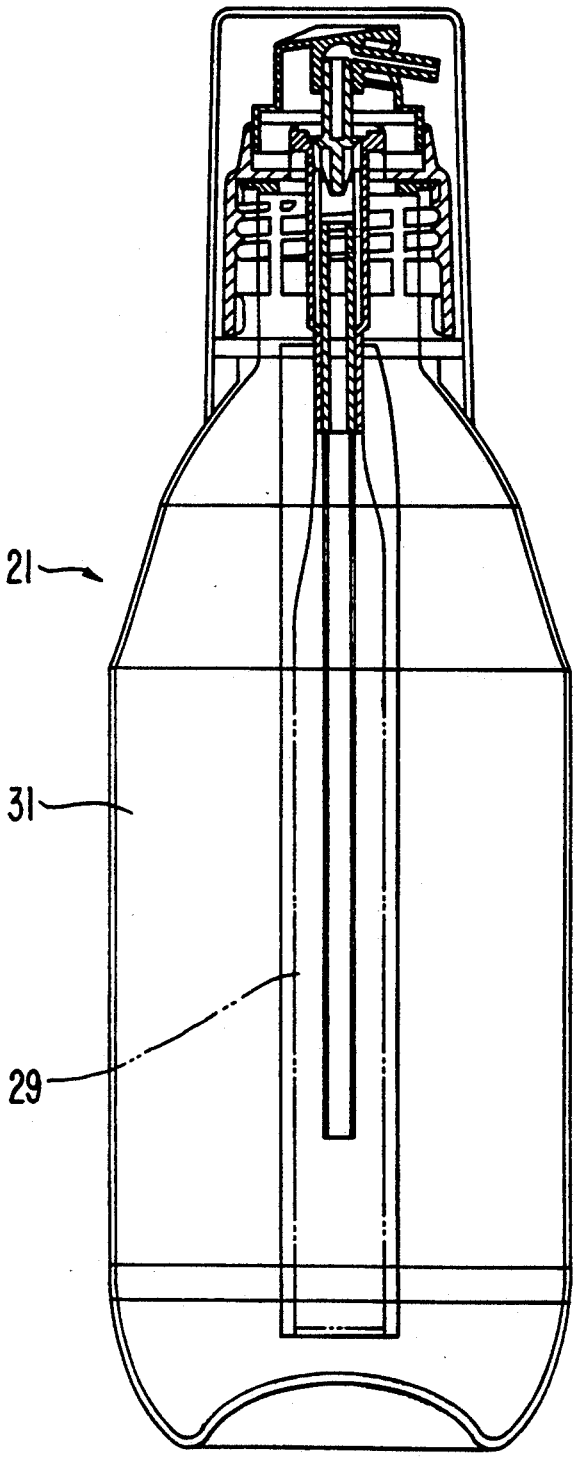
FIG. 2B is a side view, partially in cross-section, taken along the longitudinal central axis of a barrier pack container according to a second embodiment of the invention.
Figure 2C:
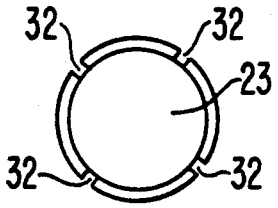
FIG. 2C is a top view of the upper end of the threaded plastic container of the barrier pack container of FIG. 2B depicting vertical slots formed in the screw threads of the container.
Figure 2D:
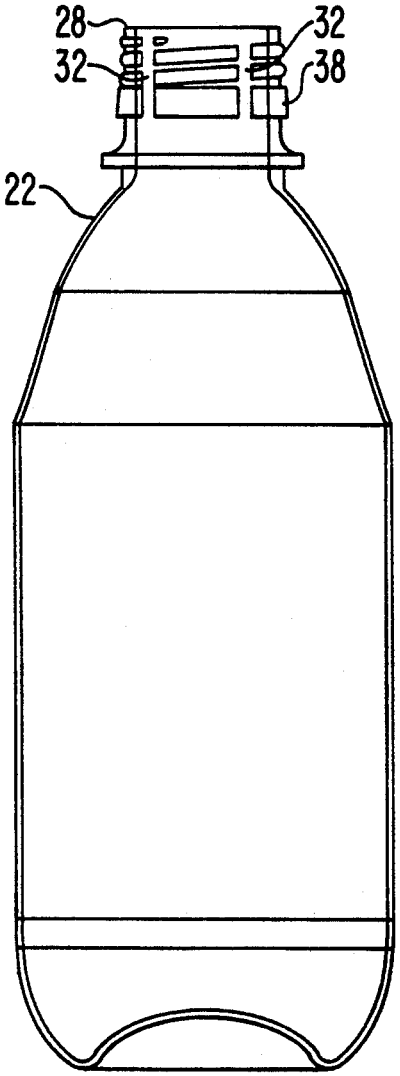
FIG. 2D is an elevational view of the threaded plastic container of the barrier pack container of FIG. 2B.

Referring now to the drawings, a container 1 according to a first embodiment of the invention illustrated in FIG. 1A–1C comprises a container body 2 having an opening 3 in a neck 4 of the container body. Screw threads 5 are formed on the container body about the opening 3. A valve 6 for dispensing a pressurized product 7 from the container 1 is fastened on the open upper end of the container body 2 by a closure 8. The closure has screw threads 9 thereon which threadedly engage the threads 5 of the container body about the opening 3.

The valve 6 in the illustrated embodiment is a conventional aerosol valve which has a dip tube 10 extending toward the bottom of container body 2. The valve 6 could have a different construction, that of a conventional tilt valve or other known valve construction for dispensing pressurized product from the container 1. The valve 6 is mounted on or formed integrally with an outer rim 11 that is held in place on the open end of the container body 2 by closure 8 to sealingly close the opening 3. The product 7 can be any fluid material capable of being forced through the valve 6 upon actuation of the valve, under the pressure of a gas propellant 12 mixed with the product in the container 1. The gas is preferably one which is not harmful to the atmosphere, for example, nitrogen gas at a pressure of several atmospheres. Other gases could be employed.

The container 1 of FIGS. 1A-1C further comprises passages for introducing pressurized gas into the container between the closure 8 and container body 2 while the closure is partially screwed onto the container body, as during assembly of the closure and associated valve on the top of container body 2. As illustrated most clearly in FIGS. 1B and 1C, the passages are in the form of a plurality of apertures 13 extending through the closure side wall in an area above and adjacent screw threads 9. Pressurized nitrogen or other gas is introduced through the apertures 13 while the closure is partially threaded onto the container body, before the opening in the container body is sealingly closed upon tightening of the closure on the container body. The pressurized gas enters apertures 13, flows between the closure and container body to the opening 3 and then into the container body through the opening. If desired, the product can also be introduced into the container through the apertures 13, or it can be filled through valve 6 or supplied to the open container body 2 prior to gassing and closing the open upper end of the container body.

Once the outer rim 11 of the valve 6 is compressed between the rim on the upper end of neck 4 of container body 2 and the opposing surface of closure 8 as a result of continued relative rotation of the closure and container body about the central longitudinal axis CL of the container 1, the opening 3 is sealingly closed thereby cutting off communication of the flow of pressurized gas from the apertures 13 into the container body and retaining the pressurized propellant gas in the container. The valve is securely mounted on the container body 2 upon tightening of the closure member on the container body.

The product 7 can be introduced into the container 1 before, during or subsequent to this gas pressurization of the container by any of the above-noted techniques. In the case of filling the product after closing the container, the product can be filled through valve 6 in a conventional manner. After the product has been completely dispensed from the container using valve 6, if desired, the valve and closure can be forcibly removed by unscrewing the closure from the container body, for disposal and recycling of at least the container body, or valve assembly, or both. Remaining pressurized propellant 12 in the container body 2 is safely released through apertures 13 before the closure is completely unscrewed from the container body, thereby preventing flying off of the closure and valve during disassembly.

Preferably, the container 1 further comprises means for resisting unscrewing of the closure 8 with respect to the container body 2 during use of the container. The means for resisting unscrewing can take the form of a lower depending skirt 94 formed integrally with the closure as illustrated in the embodiment of FIGS. 2A-13 but not shown in the embodiment of FIGS. 1A-1C, . The skirt forms part of snap-on arrangement as discussed below. Instead of, or in addition to the use of the snap-on arrangement, the juncture of the closure and container body can be wrapped with plastic film to guard against accidental removal of the closure from the container body. The outer surface of the closure is also preferably smooth to make it difficult to unscrew One variation of the container illustrated in FIGS. 1A and 1B is shown in FIG. 1C where the valve 6 is mounted on threaded closure 14 such that the valve and closure constitute a single assembly for mounting on the container body 2. Container body 2 of container 1 in the embodiment of FIGS. 1A-1C is preferably formed of plastic, particularly multiple layers of bi-axially blow-stretched plastic, known as PET, but other materials and constructions could be employed. The outer rim 11 and closures 8 and 14 are also formed of plastic, polypropylene in the illustrated embodiment, but other suitable plastics may be used. The closure could also be formed of metal, e.g. steel or aluminum. The plastic of the outer rim 11 in FIGS. 1A and 1B acts as a sealing gasket when clamped between the upper rim of container body 2 and closure 8. However, a separate sealing gasket or gaskets of conventional resilient material, not shown, may be employed to aid in sealingly closing the opening of the container body by the closure and associated valve, as needed.

A barrier pack, pressurized dispensing container and components therefor according to the invention are depicted in FIGS. 2A-13 of the drawings. The barrier pack container 21 comprises a standard size, threaded plastic container body 22. An opening 23 in the upper end of the container body 22 is closed by a closure 24 in the form of a threaded plastic cap on which an aerosol valve 25 is mounted. The cap 24 is fastened on the top of the outer container 22 by the threaded engagement of the respective screw threads on the cap and container body as a result of relative rotation of the cap and container body. A resilient annular gasket or seal 71 formed of rubber or plastic is located between the outer rim 26 of a valve cup 27 of the valve 25 and the upper rim 28 on the container body 22 about the opening 23 to sealingly close the opening when the cap is tightly screwed onto the container body.

An inner collapsible container 29 is located within the container body 22 for containing the product to be stored and dispensed from the container 21. The inner collapsible container 29 is in the form of a bag or pouch and is preferably formed of flexible sheet material such as a conventional laminated film of polypropylene, aluminum foil and nylon layers bonded to one another, but other materials could be employed. The collapsible container is bonded to the valve body 30 of the valve 25 by heat sealing. Adhesive bonding could also be used for joining the two.

In a preferred form of the valve body 30 of the valve 25, as shown in detail in FIGS. 9-13, the valve body has an outer surface on a depending portion of the valve body to which the collapsible container is bonded. This outer surface, as seen in a cross-section taken perpendicular to a longitudinal central axis of the valve body, has outwardly flared portions 33 and 34 on opposite sides of the valve body. The flared portions each taper to an outer tip 35. The tapered surfaces of the flared portions are harmonically curved surfaces in the disclosed embodiment so that the flexible sheet material of the collapsible container 29 flows smoothly along the valve body and is not bunched. It has been found that this arrangement facilitates bonding and reduces the likelihood of leaks at the connection of the collapsible container and valve as compared with a connection between a collapsible container and a conventional cylindrically shaped valve body. The width D, of the valve body across the flared portions 33 and 34 in the preferred embodiment is 0.336 inch while that at right angles to the flared portions is only 0.266 inch. The outer tips 35 have a radius of curvatures at their end in excess of 0.003 inch.

An intermediate chamber 31 is defined in the container 21 between the inner collapsible container 29 and outer container body 22. A pressurized gas, illustratively nitrogen at a pressure of several atmospheres, is contained in the intermediate chamber 31 for pressuring the collapsible container 29 and the product therein. The pressurized gas thus acts to eject or propel the product in container 29 from the container through the valve 25 upon actuation of the valve.

For introducing pressurized gas into the intermediate chamber 29 during assembly of the cap with valve on the outer container body 22, gas passages in the form of vertical slots 32 are provided in the threads of the outer container body 22. The slots permit passage of pressurized gas into the container during threading of the cap onto the container body, that is until the upper rim of the container body is sealed against the cap by way of the seal 71 and the outer rim 26 of the valve cup of valve 25 to block further communication between the passages 32 and the opening 23 in the container body 22. Apertures, as at 13 in FIGS. 1A–1C could be used for gas passage instead of or in addition to the slots. Likewise, slots could be employed in the embodiments of FIGS. 1A–1C in place of or in addition to the apertures 13.

Figure 3:
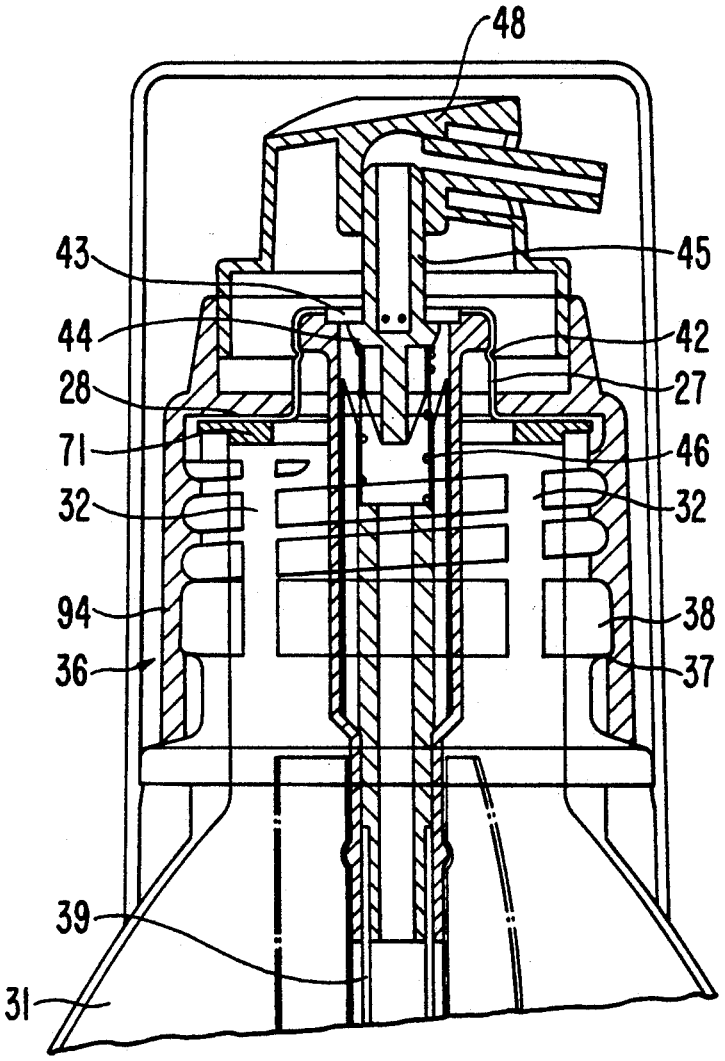
FIG. 3 is an enlarged cross-sectional view of a portion of the upper end of the container of FIG. 2B.
Figure 4:
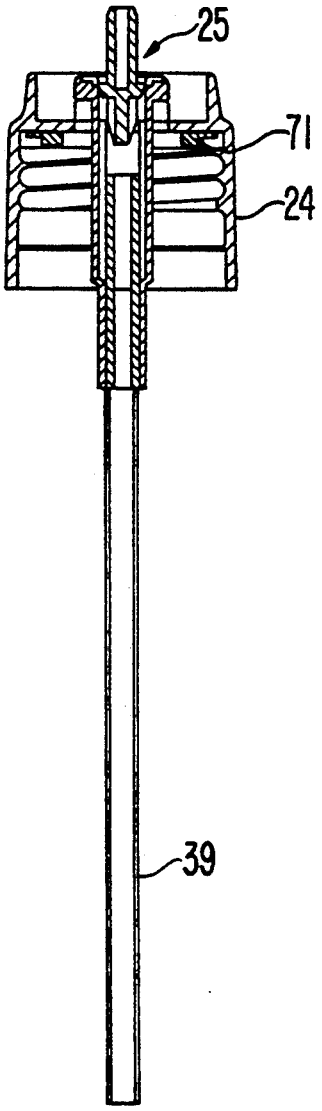
FIG. 4 is a side elevational view of an assembly of the threaded cap, valve and seal employed in the container of FIG. 2B.
Figure 5:
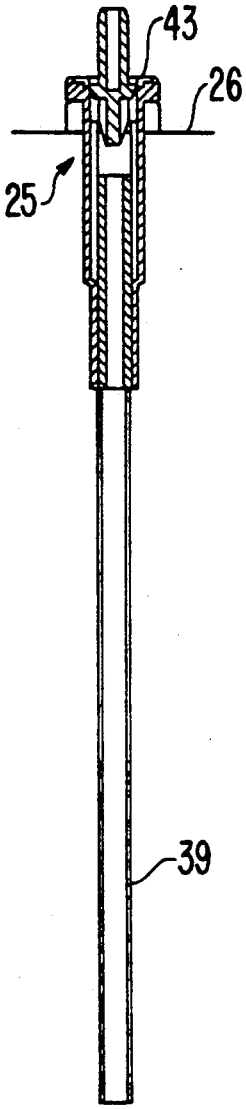
FIG. 5 is a side elevational view, partially in cross-section, of the valve of the container of FIG. 2B with a dip tube attached to the lower end of the valve.
Figure 6:
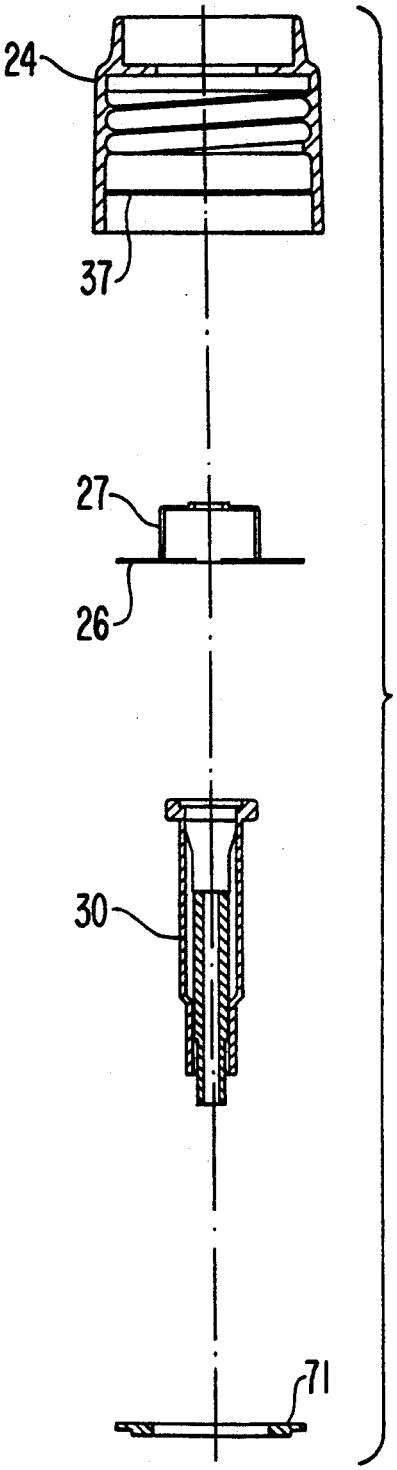
FIG. 6 is an elevational view of a valve cup and valve body of the valve, shown in disassembled relation along with the closure and seal of the assembly of FIG. 4.
Figure 10:
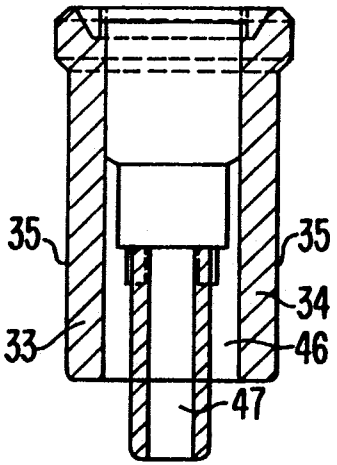
FIG. 10 is a cross-sectional view of the valve body of FIG. 9 taken along the central longitudinal axis of the valve body.
Figure 9:
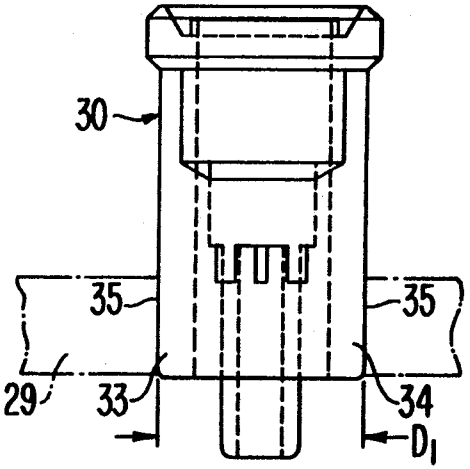
FIG. 9 is an enlarged (3:1) elevational view of a preferred form of the valve body of the valve for the container of FIG. 2B to which the collapsible container is bonded.
Figure 8:
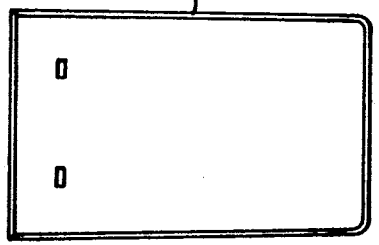
FIG. 8 is a side view of the cap of FIGS. 2B and 7.
Figure 7:
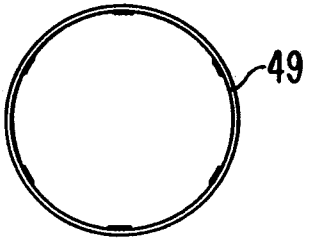
FIG. 7 is a end view of a cap of the container of FIG. 2B.

A snap-on arrangement 36 for resisting unscrewing of the cap 24 from the container body 22 comprises a skirt 94 depending from the lower, outer end of the threaded cap 24. The skirt 94 is formed with a radially inwardly extending annular projection 37. The projection and skirt are deflected over an annular flange 38 on the neck of the container body 22 beneath the screw threads thereon. The annular projection 37 snaps radially inwardly below the flange 38 when the cap is threadedly tightened on the container body 22 to sealingly close the opening 23 as depicted in FIG. 3. In this position, the flange resists unscrewing and axial translation of the cap relative to the container body to deter accidental opening of the container with loss of pressurization. Preferably, the outer surface of the cap 24 is smooth so as not to suggest or facilitate rotation of the cap relative to the container body. The slots 32 through the screw threads on the container body 22 also extend through flange 38.

The valve body 30 is formed of plastic as by injection molding in the illustrated embodiment. A dip tube 39 is inserted in an annular slot 40 in the bottom of the valve body to define a flow passage for product being dispensed from the container. The valve body is supported in the metal valve cup 27. The valve cup is crimped inwardly at 42 about the upper, flanged end of the valve body to retain it within the valve cup. A valve seat 43 of rubber or plastic is clamped between the valve body and valve cup for cooperation with a valve head 44 on a valve stem 45. A metal spring 46 resiliently biases the valve head against the seat 43 to close a through passage 47 in the valve.

The valve 25 is actuated for dispensing product from the collapsible container 29 by depressing the valve stem. A dispensing nozzle 48 is provided atop the valve stem for actuating the valve and directing the dispensed product. The product to be dispensed from the container 21 is necessarily flowable through the valve 25 and may include an aerosol or vehicle to facilitate transport and dispersion of the stored product. An outer cap 49 is removably positioned over the valve 25 and dispensing nozzle 48, see FIGS. 2B, 3, 7 and 8, when the container is not in use.

Figure 13:
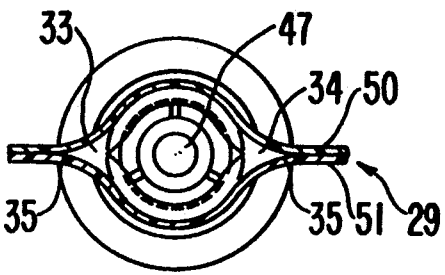
FIG. 13 is an end view of the valve body of FIGS. 9–12 taken from the right side of FIG. 12 and depicting a portion of the collapsible container bonded to the valve body.
Figure 12:
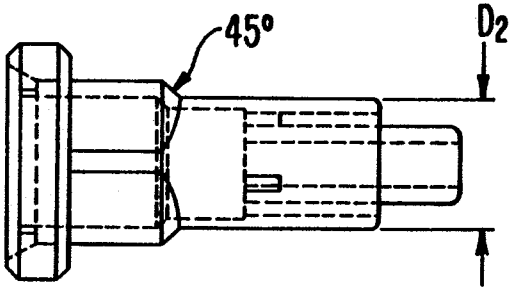
FIG. 12 is a side elevational view of the valve body of FIG. 9 taken from the left side of FIG. 9 and showing the valve body horizontally extending.
Figure 11:
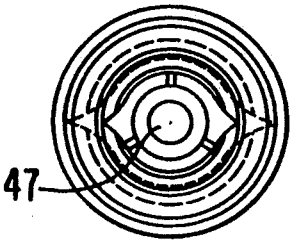
FIG. 11 is an end view of the valve body of FIGS. 9, 10, 12 and 13 taken from the left side of FIG. 12.

According to the method of making a pressurized dispensing container of the invention, a valve 25 according to the invention is mounted on the threaded cap 24 together with seal 71, to form an assembly. Opposing sheets of flexible material 50 and 51 of the inner collapsible container 29 are bonded to the valve about the flared portions of the outer surface of the valve body as shown in FIG. 13. The opposed sheets 50 and 51 are also bonded to one another about the periphery of the collapsible bag or pouch to form a sealed container for the product which is sealingly connected to the valve with ingress and egress of the product to and from the pouch being solely through the through passage 47 in the valve 25 and dip tube 39 upon opening of the valve 25.

The assembly of threaded cap, valve and seal and the unfilled collapsible bag or pouch bonded is then inserted into the opening 22 of the container body. Relative rotation of the assembly and container body threadedly advances the cap onto the container body until the seal 71 is compressed against the upper rim 28 of the container body to close the opening 23. Prior to this closure, pressurized gas is introduced into the intermediate chamber 31 of the container by way of the slots 32, the space between the assembly and the upper rim 28 of the container body, and opening 23 in the container body. To this end, the threading of the cap on the container body can take place within an enclosed vessel or shroud about the upper end of the container into which pressurized gas is introduced prior to tightening the cap on the container body to sealingly close the opening 23. The collapsible container 29 is then filled through valve 25 with product to be stored and dispensed. Depending upon the configuration of the container, the collapsible container 29 could be filled with product prior to gassing the intermediate chamber 31 of the container, instead of after gassing. The screw thread on the container body are preferably steep threads such as buttress threads for resisting the pressure on the cap 24.

While the product stored and dispensed from the container 21 can be any flowable material, the container has been found advantageous for storing and dispensing sterile products including saline solution since the valve precludes introduction of atmospheric contamination into the product within the container. Therefore, a sterile product will not be contaminated by atmospheric contaminants during storage. Oxygen contamination of stored food products can also be avoided. To this end, the container is useful for storing and dispensing liquid coffee concentrate. The freshness of the coffee concentrate is retained until it is dispensed from the container for use by the consumer. These advantages are attained with the container of the invention in a relatively low cost, reliable manner that does not require bottom gassing. The possibility of leakage is minimized and the construction materials of the container can be largely plastic without fear of the closure and valve flying off the container.

While we have shown and described only two embodiments in accordance with the present invention, it is understood that the same is not limited thereto, but is susceptible to numerous changes and modifications as known to those skilled in the art. Therefore, we do not wish to be limited to the details shown and described herein, but intend to cover all such changes and modifications as are encompassed by the scope of the appended claims.

We claim:

1. A container for storing a product under pressure and dispensing the stored product, comprising a container body having an opening with screw threads arranged on the container body about the opening, a valve for dispensing a pressurized product from the container, a closure having screw threads thereon in threaded engagement with the threads of the container body about said opening for fastening the closure and the valve to the container body to close said opening, and at least one passage in at least one of the container body and the closure through which pressurized gas can be flowed into the container body through said opening when the closure is being screwed onto the container body, pressurized gas flow communication between said at least one passage and the container body opening being closed as a result of closure of said opening by the closure and the valve when the closure is screwed tightly onto the container body.

2. The container according to claim 1, wherein said valve is mounted on said closure.

3. The container according to claim 1, wherein said opening of the container body is located in a threaded neck of the container body.

4. The container according to claim 1, further comprising a product mixed with a propellant in said container.

5. The container according to claim 1, wherein said container body is a standard size container body with a threaded top.

6. The container according to claim 1, wherein said at least one passage is located radially outward of said container body opening in at least one of the container body and the closure.

7. The container according to claim 1, wherein said at least one passage includes slots formed in the screw threads of at least one of the container body and the closure, said slots extending transverse to the screw threads.

8. The container according to claim 7, wherein said slots are formed in the screw threads of the container body.

9. The container according to claim 1, wherein said at least one passage includes apertures extending through the closure.

10. The container according to claim 9, wherein said apertures are located adjacent said screw threads of the closure.

11. The container according to claim 1, further comprising means for resisting unscrewing of the closure with respect to the container body.

12. The container according to claim 11, wherein said means for resisting includes a snap-on arrangement between respective portions of said closure and said container body which are engaged with one another to resist unscrewing of the closure as a result of the closure being screwed onto the container body.

13. The container according to claim 12, wherein said portion of the closure is a projection and said portion of the container body is a flange engaged by said projection, said projection being forced over said flange when the closure is screwed onto the container body.

14. The container according to claim 1, wherein the container body is formed of plastic.

15. The container according to claim 1, wherein the closure is formed of plastic.

16. The container according to claim 1, further comprising a seal which extends about said container body opening between said valve and said container body.

17. The container according to claim 16, wherein said seal engages said container body and the outer rim of a valve cup of said valve, said valve cup and seal being pressed in the direction of said container by said closure to close said opening.

18. The container according to claim 1, further comprising an inner collapsible container located within said container body for containing a pressurized product, said inner collapsible container being arranged within the container body such that the interior of the inner collapsible container is in communication with said valve for dispensing product in the inner collapsible container from the container, an intermediate chamber being defined in the container between the container body and the inner collapsible container with the pressurized gas being located in said intermediate chamber for pressuring the inner collapsible container.

19. The container according to claim 18, further comprising sterile saline solution in said inner collapsible container.

20. The container according to claim 18, further comprising liquid coffee concentrate in said inner collapsible container.

21. A container according to claim 18, wherein said inner collapsible container is in the form of a bag or pouch formed of a flexible, single layer or laminated material.

22. The container according to claim 18, wherein said inner collapsible container is retained on said valve such that pressurized gas can flow into said intermediate chamber through said at least one passage before the closure is screwed tightly onto the container body.

23. The container according to claim 18, wherein said inner collapsible container is bonded to a portion of the valve for retaining the inner collapsible container on the valve.

24. The container according to claim 23, wherein said portion of the valve to which said inner collapsible container is bonded has an outward configuration, as seen in a cross-section taken perpendicular to a longitudinal central axis of said portion, which has on each of two opposite sides thereof an outwardly flared portion which tapers to an outer tip of the flared portion.

25. The container according to claim 24, wherein said flared portions taper along harmonic curves.

26. An assembly for threaded connection to a plastic outer container body for making a barrier pack, pressurized dispensing container, said assembly comprising a closure for the container, a valve for dispensing a pressurized product from the container, and a collapsible container bonded to the valve for use as an inner container for containing a product within the outer container body of the barrier pack container to define an intermediate chamber in the barrier pack, pressurized dispensing container between the outer container body and the inner collapsible container, said closure having screw threads thereon for engaging screw threads on the outer container body about an opening in the outer container body, and said collapsible container being bonded to the valve such that during screwing of the closure on the outer container body pressurized gas can be introduced in the intermediate chamber of the container between the inner collapsible container and the outer container body before the closure is screwed tightly onto the outer container body.

27. An assembly according to claim 26, further comprising means on the closure for resisting unscrewing of the closure with respect to the outer container body after the closure has been tightly screwed onto the outer container body.

28. An assembly according to claim 27, wherein said means for resisting comprises a radially inwardly extending projection on said closure which forms part of a snap-on arrangement with the outer container body when the closure is screwed tightly onto the outer container body.

29. An assembly for making a barrier pack pressurized dispensing container, said assembly comprising a closure for the container, a valve for dispensing a pressurized product from the container, and a collapsible container for use as an inner container for containing a product within the outer container body of the barrier pack container to define an intermediate chamber in the barrier pack, pressurized dispensing container between the outer container body and the inner collapsible container, said closure having screw threads thereon for engaging screw threads on the outer container body about an opening in the outer container body, and said collapsible container being retained on the valve such that during screwing of the closure on the outer container body pressurized gas can be introduced into the intermediate chamber of the container between the inner collapsible container and the outer container body before the closure is screwed tightly onto the outer container body, wherein said closure includes at least one passage through which pressurized gas can be flowed into the intermediate chamber of the barrier pack container through said opening in the outer container body when the closure is partially screwed onto the outer container body, communication between said at least one passage and the opening in the outer container body being closed when the closure is screwed tightly onto the outer container body to close said opening.

30. An assembly according to claim 29, wherein the at least one passage includes apertures extending through the closure.

31. An assembly according to claim 30, wherein said apertures are located adjacent the screw threads of the closure.

32. An assembly for making a barrier pack pressurized dispensing container, said assembly comprising a closure for the container, a valve for dispensing a pressurized product from the container, and a collapsible container for use as an inner container for containing a product within the outer container body of the barrier pack container to define an intermediate chamber in the barrier pack, pressurized dispensing container between the outer container body and the inner collapsible container, said closure having screw threads thereon for engaging screw threads on the outer container body about an opening in the outer container body, and said collapsible container being retained on the valve such that during screwing of the closure on the outer container body pressurized gas can be introduced into the intermediate chamber of the container between the inner collapsible container and the outer container body before the closure is screwed tightly onto the outer container body, wherein said collapsible container is bonded to the outer surface of a portion of the valve which, as seen in a cross-section taken perpendicular to a longitudinal central axis of said portion, has an outwardly flared portion on each of two opposite sides, each outwardly flared portion tapering to an outer tip.

33. An assembly according to claim 32, wherein said flared portions taper along harmonic curves.

34. An assembly for making a barrier pack pressurized dispensing container, said assembly comprising a closure for the container, a valve for dispensing a pressurized product from the container, and a collapsible container for use as an inner container for containing a product within the outer container body of the barrier pack container to define an intermediate chamber in the barrier pack, pressurized dispensing container between the outer container body and the inner collapsible container, said closure having screw threads thereon for engaging screw threads on the outer container body about an opening in the outer container body, and said collapsible container being retained on the valve such that during screwing of the closure on the outer container body pressurized gas can be introduced into the intermediate chamber of the container between the inner collapsible container and the outer container body before the closure is screwed tightly onto the outer container body, wherein said collapsible container is in the form of a bag or pouch formed of a flexible sheet material which is bonded to said valve.

35. An assembly for making a barrier pack pressurized dispensing container, said assembly comprising a closure for the container, a valve for dispensing a pressurized product from the container, and a collapsible container for use as an inner container for containing a product within the outer container body of the barrier pack container to define an intermediate chamber in the barrier pack, pressurized dispensing container between the outer container body and the inner collapsible container, said closure having screw threads thereon for engaging screw threads on the outer container body about an opening in the outer container body, and said collapsible container being bonded to the valve such that during screwing of the closure on the outer container body pressurized gas can be introduced into the intermediate chamber of the container between the inner collapsible container and the outer container body before the closure is screwed tightly onto the outer container body, wherein said valve comprises a valve cup with an outer rim, and wherein said assembly further comprises a seal which extends about the outer rim of the valve cup of the valve for sealing between the valve and outer container body when the closure is screwed tightly onto the outer container body.

36. An assembly according to claim 35, wherein said valve and said seal are mounted on said closure for threaded connection to the outer container body.

37. A valve for a barrier pack, pressurized dispensing container, comprising a valve body, a passage extending through said valve body, a valve stem with valve head which is movable for opening and closing said passage, wherein at least a portion of the outer surface of the valve body, as seen in a cross-section taken perpendicular to a longitudinal central axis of said passage, has on each of two opposite sides thereof an outwardly flared portion which tapers to an outer tip.

38. The valve according to claim 37, wherein the outwardly flared portions taper along harmonic curves.

39. The valve according to claim 37, further comprising a valve cup in which the valve body is supported, said valve cup having an outer rim by which said valve can be clamping supported in a container.

40. A method of making a pressurized dispensing container comprising providing a container body, a threaded closure for the container body and a valve for said container, said container body having an opening with screws threads arranged on the container body about the opening, and sealingly closing said opening in the container body by screwing the threaded closure onto the threaded container body so as to mount said closure and the valve on said container body, and wherein said method includes introducing a pressurized gas into the container between the closure and container body before said closure is completely screwed onto said container body for sealingly closing the opening in the container body.

41. The method according to claim 40, including providing means for resisting accidental unscrewing of the closure with respect to the container body.

42. The method according to claim 40, including providing an inner collapsible container within the container body before said closing so as to define an intermediate chamber in the container between the container body and the inner collapsible container, and wherein said pressurized gas is introduced into said intermediate chamber of the container for pressuring the inner collapsible container.

43. The method according to claim 42, including bonding the inner collapsible container to a portion of the valve which has outwardly flared portions on opposite sides thereof, said outwardly flared portions each tapering to an outer tip.

44. The method according to claim 40, including introducing a product into the container through said valve subsequent to sealingly closing said opening of the container body with said closure.

45. The method according to claim 40, wherein at least one passage is formed in the container body said pressurized gas being introduced through the at least one passage when the closure is being screwed onto the container body for flowing the gas between the closure and container body.

46. The method according to claim 40, wherein at least one passage is formed in the closure, said pressurized gas being introduced through the at least one passage when the closure is being screwed onto the container body for flowing the gas between the closure and container body.

* * * * *